US006432269B1

(12) United States Patent
Dragner

(10) Patent No.: US 6,432,269 B1
(45) Date of Patent: Aug. 13, 2002

(54) OPACIFIER FOR ALKALINE PAPER

(75) Inventor: Louis Robert Dragner, Rock Hill, SC (US)

(73) Assignee: Omnova Solutions Inc., Fairlawn, OH (US)

( * ) Notice: Subject to any disclaimer, the term of this patent is extended or adjusted under 35 U.S.C. 154(b) by 37 days.

(21) Appl. No.: 09/592,063

(22) Filed: Jun. 12, 2000

(51) Int. Cl.[7] ..... D21H 17/72; D21H 21/14

(52) U.S. Cl. ..... 162/158; 162/179; 162/164.1; 162/168.1; 106/243; 106/287.23; 106/287.25

(58) Field of Search ..... 162/158, 164.1, 162/168.1; 106/243, 287.23, 287.25

(56) References Cited

U.S. PATENT DOCUMENTS 3,992,249 A * 11/1976 Farley ..... 162/DIG. 4
5,244,542 A 9/1993 Bown et al.
5,293,363 A 3/1994 Takeshita
5,296,024 A 3/1994 Hutcheson
5,384,013 A 1/1995 Husband et al.
5,393,334 A 2/1995 Hutcheson
5,417,753 A 5/1995 Hutcheson
5,456,800 A * 10/1995 Tansley et al. ..... 162/158
5,472,486 A 12/1995 Dragner et al.
5,478,387 A 12/1995 Dragner et al.
5,488,139 A 1/1996 Dragner et al.
5,492,600 A 2/1996 Dragner et al.
5,494,555 A 2/1996 Dragner et al.
5,498,315 A 3/1996 Dragner et al.
5,626,719 A * 5/1997 Tansley et al. ..... 162/158
5,667,638 A 9/1997 Dragner et al.
5,736,008 A 4/1998 Barrows et al.
5,902,455 A 5/1999 Hund et al.
6,165,259 A * 12/2000 Hallstrom et al. ..... 106/243

OTHER PUBLICATIONS

"When it comes to paper making . . . size matters", Chemical Engineering, Aug. 26, 1999.
Styrene Acrylic Resin chart by Johnson Polymer (undated).

* cited by examiner

*Primary Examiner*—Peter Chin
(74) *Attorney, Agent, or Firm*—Robert F. Rywalski; Mary E. Golrick

(57) ABSTRACT

A novel opacifying composition for use with alkaline paper which does not react with alkyl succinic anhydride, is provided. The opacifier comprises a mixture of an aromatic polymer, preferably a styrene acrylic polymer, and a stearamide which preferably comprises either a mono-stearamide or a di-stearamide of amino ethyl ethanol amine or both a mono-stearamide or a di-stearamide of amino ethyl ethanol amine. The opacifying composition comprises the opacifier and water. The water is preferably present in an effective amount to provide the opacifying composition in a liquid, emulsion form. Preferably the opacifier comprises from 5% to 60%, more preferably from 15% to 50% , most preferably from 30% to 40% aromatic polymer and preferably from 40% to 95%, more preferably from 50% to 85%, most preferably from 60% to 70% of the stearamide. A base is preferably present in an effective amount to provide the opacifying composition with a pH of from 7.5 to 11.0.

26 Claims, No Drawings

OPACIFIER FOR ALKALINE PAPER

BACKGROUND OF THE INVENTION

Alkaline paper differs from acid paper in that some alkaline paper contains internal sizing (added to the wood pulp rather than to surface of the paper), such as, alkyl succinic anhydride (ASA), to prevent rewetting of the paper. However, certain conventional opacifiers such as mixtures of the mono- and di-stearamides of amino ethyl ethanol amine, tend to react with the ASA sizing which prevents the sizing from functioning. As a result, the paper absorbs water.

It would be desirable to have an opacifier for alkaline paper which does not react with alkyl succinic anhydride.

SUMMARY OF THE INVENTION

The present invention provides a novel opacifier and opacifying composition for use with alkaline paper which does not react with alkyl succinic anhydride. The opacifier comprises a mixture of: an aromatic polymer, preferably an aromatic acrylic polymer or an aromatic anhydride polymer, more preferably a styrene acrylic polymer or a styrene maleic anhydride polymer; and a stearamide. The stearamide preferably comprises either a mono-stearamide or a di-stearamide of an ethanol amine, more preferably the stearamide comprises both a mono-stearamide and a di-stearamide of an ethanol amine, preferably an amino ethyl ethanol amine. Preferably the opacifier comprises from 5% to 60%, more preferably from 15% to 50%, most preferably from 30% to 40% aromatic polymer and preferably from 40% to 95%, more preferably from 50% to 85%, most preferably from 60% to 70% of the stearamide.

Preferably the opacifying composition comprises from 0.01% to 100%, more preferably from 2 to 50%, even more preferably from 3% to 40%, most preferably from 5% to 35%, opacifier; and from 0% to 99.99%, preferably from 0.001 to 99.99%, more preferably from 50% to 98%, even more preferably from 60% to 97% water; most preferably from 65% to 95% water. The water is preferably present in an effective amount to emulsify the opacifier and thus to provide the opacifying composition in a liquid, emulsion form. A base is preferably present in an effective amount to provide the opacifying composition with a pH greater than 7.5. The base is preferably present in an effective amount to provide the opacifying composition with a pH of from 7.5 to 11.0. In a embodiment where water is employed, the opacifying composition is preferably an emulsion.

When the opacifying composition is added to the alkaline wood pulp, the paper produced therefrom has the desired opacity, brightness and non-absorbency. The inventions also relate to paper, methods of enhancing optical properties of paper and to methods of making the novel opacifying compositions.

DETAILED DESCRIPTION OF THE INVENTION

The present invention provides a novel opacifying composition for use with alkaline paper which does not react with alkyl succinic anhydride. As used herein, "paper" means a matted or felted sheet of fiber. Preferably the fiber is cellulose. The opacifying composition comprises a mixture of an aromatic polymer, preferably a styrene acrylic polymer, and a stearamide which preferably comprises a mono-stearamide or a di-stearamide of amino ethyl ethanol amine. Most preferably the stearamide comprises both a mono-stearamide or a di-stearamide of amino ethyl ethanol amine. Preferably the opacifier comprises from 5% to 60%, more preferably from 15% to 50% , most preferably from 30% to 40% aromatic polymer and preferably from 40% to 95%, more preferably from 50% to 85%, most preferably from 60% to 70% of the stearamide.

Preferably the opacifying composition comprises from 1% to 100%, more preferably from 2 to 50%, even more preferably from 3% to 40%, most preferably from 5% to 35%, opacifier, and from 0% to 99%, more preferably from 0.001 to 99%, even more preferably from 50% to 98%, most preferably from 60% to 97% water. The water is preferably present in an effective amount to provide the opacifying composition in a liquid, emulsion form. Thus, the opacifying composition may be in solid form comprising primarily the opacifier, or in liquid form comprising water and the opacifier.

A base is preferably present in an effective amount to provide the opacifying composition with a pH greater than 7.5. The base is preferably present in an effective amount to provide the opacifying composition with a pH of from 7.5 to 11.0.

When the opacifying composition is added to the alkaline wood pulp, the paper produced therefrom has the desired opacity, brightness and non-absorbency. As used herein, "alkaline wood pulp" means the wood pulp has a pH of from 6.5 to 9.0.

The Aromatic Polymer

The aromatic polymer is preferably an aromatic acrylic polymer or an aromatic anyhdride polymer, preferably a styrene acrylic polymer, or a styrene maleic anhydride resin. Preferably the aromatic polymer has a molecular weight of from 500 to 16,500.

The Aromatic Acrylic Polymer

Preferably the aromatic acrylic polymer has a weight average molecular weight of from 4,000 to 16,500 more preferably from 7,000 to 10,000, most preferably from 7,500 to 9,000. Preferably the styrene acrylic polymer has a softening point from 53° C. to 300° C., more preferably 70° C. to 250° C., most preferably from 90° C. to 185° C., an acid number preferably from 40 to 280, more preferably from 100 to 260, most preferably from 150 to 230, a density of preferably from 1.05 to 1.6, more preferably from 1.09 to 1.5, most preferably from 1.1 to 1.2, and a glass transition temperature of preferably from 40° C. to 140° C., more preferably from 45° C. to 130° C., most preferably from 65° C. to 105° C.

Preferably the aromatic acrylic polymer is a styrene acrylic polymer. A suitable styrene acrylic polymer has a weight average molecular weight of 8,000 and is commercially available under the tradename Morez 101 from Morton. A suitable styrene acrylic polymer has a weight average molecular weight of 8,500, an acid number of 215, a softening point of 165° C., a glass transition temperature of 85° C., and a density of 1.13 and is commercially available under the trade name Joncryl 678 from Johnson Polymer.

The Aromatic Anhydride Resin

The aromatic anyhdride resin preferably has a weight average molecular weight of 500 to 10,000. The aromatic anhydride resin is a copolymer of a substituted aromatic ring and an anhydride, preferably a copolymer of styrene and maleic anhydride and the esters and salts thereof, preferably having aromatic:anhydride ratio of from 1 to 3:1. Preferably the aromatic anhydride has a melting point range of from 45–180° C., more preferably 100–175° C., most preferably from 150–170° C. Preferably the aromatic anhydride has an acid number of from 100 to 500, more preferably from 106 to 490, most preferably from 350 to 485 and preferably a 15% NVM viscosity of from 10 to 60, more preferably 12 to 26, most preferably 15 to 20 cP at 30° C.

Preferably the aromatic anhydride resin is a styrene maleic anhydride resin. A suitable styrene maleic anhydride resin is a styrene maleic anhydride copolymer, having a weight average molecular weight of 8,000, a melting point range of 150–170° C., and acid number of 480 a 15% NVM viscosity of 17 cP at 30° C. and a styrene: maleic anhydride ratio of 1:1, a Gardner color of 1-2, and is commercially available under the trade name SMA® 1000 from Atochem North America Inc.

The Stearamide

The stearamide has the following general structure:

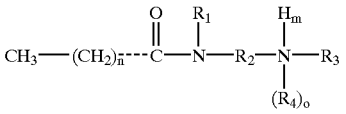

wherein:

m is an integer from 0–1;

n is either an integer from 11 to 23; preferably from 15 to 17;

o is an integer from 0–1;

$R_1$ is a hydrogen;

$R_2$ is an alkyl group having from 1 to 15 carbon atoms preferably 2 to 6 carbon atoms;

$R_3$ is an aliphatic alcohol group having from 1 to 15 carbon atoms preferably 2 to 6 carbon atoms;

and $R_4$ is

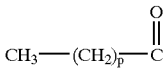

wherein p is an integer from 11 to 23, preferably 15 to 17.

Preferably the stearamide comprises either a monostearamide or a di-stearamide or a mixture of both. Preferably the stearamide comprises from 1% to 50%, more preferably from 10% to 30% of at least one mono-stearamide; and from 50% to 99%, more preferably from 70% to 90% of at least one di-stearamide. Preferably the mono-stearamide is a mono-stearamide of amino ethyl ethanol amine and has the following formula:

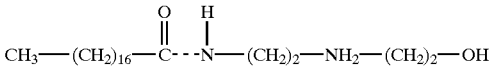

Preferably. the di-stearamide of amino ethyl ethanol amine has the following formula:

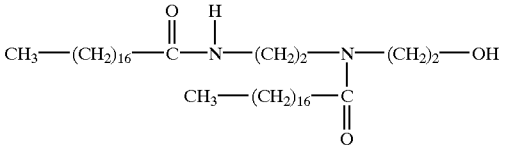

A suitable stearamide is a mixture of the mono-stearamide a the di-stearamide of the amino ethyl ethanol amine and is commercially available under the trademark, Reactopaque® from Omnova Solutions Inc. formerly GenCorp.

Suitable bis-stearamide ethoxylates are for example, methylbis-(tallowamidoethyl)-2-hydroxyethyl ammonium methyl sulfates and esters thereof, are commercially available under the trademarks, Accosoft® and Stepanix®; particularly suitable is The Accosoft® 550, from the Stepan Company.

Optionally, the opacifying composition further comprises an alkyl alcohol ether to stabilize the emulsion of the opacifying composition. Dipropylene glycol methyl ether is the preferred.

Optionally, the opacifying composition further comprises an emulsifier to promote homogeneity. Conventional emulsifiers are suitable. Good results have been obtained using 5% of a nonyl phenol with 40 moles of ethylene oxide emulsifier commercially available under the trade name Triton x-405 from Rohm and Haas.

Preparation of the Opacifying Composition

Preferably, the opacifying composition is prepared by heating the stearamide under an inert atmosphere with agitation. Good results have been obtained by heating to 125° C. The aromatic polymer is then added and mixed; good results have been obtained by mixing for one hour. The opacifying composition is then preferably cooled. The opacifying composition is then combined with water and a base preferably ammonia, and then heated until the base is solubilized. Good results have been obtained by heating to 90° C.

The emulsified form of the opacifying composition is formed by adding water which contains a base, such as ammonia, sodium hydroxide, monoethanolamine, diethanolamine, triethanolamine, or potassium hydroxide, and heating with agitation. Good results have been obtained by heating at 90° C. for 60 minutes or until the opacifying composition is solubilized.

The opacifying composition is added to a pulp slurry, also known in the art as a "furnish", which then is used to form a paper sheet. The pulp slurry is made using conventional techniques. The pulp slurry contains typically cellulose fiber derived from hardwood or soft wood or a mixture of the two.

After the pulp slurry is formed, it is stored in holding tanks or fed into a papermaking machine. The opacifying composition is added to the pulp slurry after the pulp has been bleached, but before the pulp enters the head box of the paper making machine. The opacifying composition is added to the slurry when the pulp slurry is in the holding tank or is added to the pulp slurry as it moves along to the headbox of the papermaking machine. The opacifying composition is added preferably from 0.1 to 15 pounds/ton, more preferably from 0.5 to 12 pounds/ton, even more preferably from 1 to 7 pounds/ton, most preferably from 2 to 4 pounds/ton of pulp slurry.

The paper made from the pulp slurry containing the opacifying composition is made using conventional techniques.

The Paper

The paper of the present invention comprises cellulose fibers; an aromatic polymer; and a stearamide. As used herein, "paper" means all types of sheets containing cellulosic fiber and includes but is not limited to, tissue, toweling, cardboard, newsprint, fine paper, lightweight coated paper, bible grade phone book grade, super calendar grade, liner board, reply card grade, cylinder board, super calendar grade, and filled sheets. The amount of opacifier present on the paper is preferably from 0.0 001% to 10%; more preferably from 0.01% to 5%, most preferably from 0.05% to 2%.

EXAMPLE 1

An opacifier was prepared by charging a reaction vessel which was equipped with a stirrer, heating device and inert gas sparge, with 65 grams of the stearamide, specifically a mixture of the mono-stearamide and the di-stearamide of the amino ethyl ethanol amine commercially available as Reactopaque® Base 200 from Omnova Solutions Inc., formerly GenCorp, and heating to 125° C. under an inert atmosphere with medium agitation. At 125° C. the reactor was charged with 35 grams of the Morez 101 styrene acrylic polymer and mixed for 1 hour, maintained at 125° C. for 30 to 60 minutes to ensure homogeneity, then cooled.

The opacifier was emulsified adding 11 grams of the opacifying composition to 89 grams water and 4 grams of a 20% ammonia solution. Next, the mixture was heated to 90° C. for 30 to 60 minutes, until the opacifying composition was solubilized. The opacifying emulsion was cooled; the resulting opacifying emulsion was milky white 11% nonvolatile solids with a pH greater than 9.

EXAMPLE 2

An opacifier was prepared as in Example 1.

EXAMPLE 3

An opacifier was prepared as in Example 1, except that 60% Reactopaque Base 200 and 40% styrene Acrylic Acid was used.

EXAMPLE 4

An opacifier was prepared as in Example 1.

EXAMPLE 5

An opacifier was prepared as in Example 1, except that after the addition of the Morez, the mixture was heated to 170° C. for an hour. The opacifier was emulsified as in example 1, except that 38.5 grams of the opacifier, and 307.5 grams water containing 4 grams of a 20% ammonia solution was used.

EXAMPLE 6

An opacifier was prepared as in Example 1, except that after the addition of the Morez, the mixture was heated to 154° C., held for 20 minutes cooled to 145° C. and 3 grams of dipropylene glycol methyl ether was added. The opacifier was emulsified as in example 1, except that 30 grams of the opacifier, and 234 grams water containing 6 grams of a 20% ammonia solution was used. The resulting opacifying emulsion was milky white 11% nonvolatile solids with a pH of 9.6.

EXAMPLE 7

An opacifier was prepared as in Example 6, except that 28.3 grams of dipropylene glycol methyl ether. was added. The opacifier was emulsified as in example 6. The resulting opacifying emulsion was milky white 11% nonvolatile solids with a pH of 9.6.

EXAMPLE 8

An opacifier was prepared as in Example 1, except that Reactopaque® 250 was used; Reactopaque® 250 is a mixture of 50% Reactopaque® 200 and 50% methyl bis (alkylamidoethyl)-2-hydroxyethyl ammonium methylsulfate and that after the addition of the Morez, the mixture was heated to 154°C. The opacifier was emulsified as in example 6. The resulting opacifying emulsion was milky white 11% nonvolatile solids with a pH of 9.2.

EXAMPLE 9

An opacifier was prepared as in Example 1, except that Reactopaque® 270 was used. Reactopaque® 270 is 88.5% Reactopaque® 200 completely reacted with 11.5% diethylsulfate. Also, after the addition of the Morez, the mixture was heated to 154° C. The opacifier was emulsified as in example 6. The resulting opacifying emulsion was milky white 11% nonvolatile solids with a pH of 8.9.

EXAMPLE 10

An opacifier was prepared as in Example 1, except that 75% Reactopaque® 200 was used, and 25% of the Morez was used, and after the Morez was added the mixture was heated to 154° C. The opacifier was emulsified as in example 6. The resulting opacifying emulsion was milky white 11% nonvolatile solids with a pH of 9.6.

EXAMPLE 11

An opacifier was prepared as in Example 1, except that 80% Reactopaque® 200 was used, and 20% of the Morez was used, and after the Morez was added the mixture was heated to 154° C. The opacifier was emulsified as in example 6. The resulting opacifying emulsion was milky white 11% nonvolatile solids with a pH of 10.

EXAMPLE 12

An opacifier was prepared as in Example 1, except that during emulsification, 21.2 grams of the opacifier, and 74.6 grams water containing 4 grams of a 20% ammonia solution was used. The resulting opacifying emulsions were milky white and had 19.1% nonvolatile solids.

EXAMPLE 13

An opacifier was prepared by heating 416.0 grams Reactopaque® 200 to 95° C., charging 27.2 grams dipropylene glycol methyl ether with nitrogen sparge, then charging 56.7 grams of a 20% ammonia solution, then charging 56.7 grams styrene maleic anhydride SMA 1000, and holding until ingredients are dissolved.

The opacifier was emulsified as in example 1, except that 35.7 grams of the opacifier, and 261.3 grams water containing 10 grams of a 20% ammonia solution was used. The resulting opacifying emulsion was milky white 10.3% nonvolatile solids with a pH of 9.

EXAMPLE 14

An opacifier was prepared by heating 65 grams Accosoft 550 to 125° C., charging 35 grams Morez with nitrogen sparge, using a condenser heating to 154C and holding one hour.

The opacifier was emulsified as in example 1, except that 35.7 grams of the opacifier, and 261.3 grams water containing 10 grams of a 20% ammonia solution was used. The resulting opacifying emulsion was milky white 11% nonvolatile solids with a pH of 9.1.

EXAMPLE 15

An opacifier was prepared by heating 239.9 grams Reactopaque® 200 to 95° C., charging 129.3 grams styrene maleic anhydride with nitrogen sparge, then charging 130.8 grams of a 20% ammonia solution, and holding until ingredients are dissolved.

The opacifier was emulsified as in example 1, except that 44.7 grams of the opacifier, and 249.3 grams water containing 6 grams of a 20% ammonia solution was used. The resulting opacifying emulsion was milky white, having 10.8% nonvolatile solids with a pH of 10.

EXAMPLE 15b

The opacifier and emulsion were prepared as in the previous example, except that 247.8 grams of water were used and 1.5 grams of the emulsifier Triton x-405 from Rohm and Haas was added to the emulsion.

EXAMPLE 15c

The opacifier and emulsion were prepared as in the previous example, except that 239.5 grams of water and 12 grams of the ammonia solution were used.

EXAMPLE 16

An opacifier was prepared by heating 227.9 grams Reactopaque® 200 to 95 C, charging 122.9 grams styrene maleic anhydride with nitrogen sparge, then charging 124.3 grams of a 20% ammonia solution and 24.9 dipropylene glycol methyl ether, and holding until ingredients are dissolved.

The opacifier was emulsified as in example 1, except that 47.0 grams of the opacifier, and 247.0 grams water and 6 grams of a 20% ammonia solution was used. The resulting opacifying emulsion was milky white, having 11% nonvolatile solids with a pH of 9.9.

EXAMPLE 16b

The opacifier and emulsion were prepared as in the previous example, except that 245.5 grams of water were used and 1.5 grams of Triton x-405 was added to the emulsion.

EXAMPLE 16c

The opacifier and emulsion were prepared as in the previous example, except that 239.5 grams of water was used and 12 grams of the ammonia solution was added.

EXAMPLE 16d

The opacifier and emulsion were prepared as in the previous example, except that 244.0 grams of water, 6 grams of the ammonia solution, 3.0 grams of T-405 were used.

Comparative Example

As a comparison, a conventional opacifier was used. The conventional opacifier, a mixture of a mono-stearamide a di-stearamide of the amino ethyl ethanol amine, is commercially available under the trademark, Reactopaque® from Omnova Solutions Inc., formerly GenCorp.

Evaluation

Hand sheets were made with the opacifying composition from the Examples. The opacifying composition were added to a pulp slurry containing a 50/50 mixture of hardwood pulp and softwood pulp, and alkyl succinic anhydride where desired.

The printing opacity, the scattering power, scattering coefficient and absorption coefficient, are determined TAPPI Test Method T 425 om-9.6 (1996), "Opacity of Paper (15/d geometry, illuminant a/2, 89% reflectance backing and paper backing). Briefly, a hand sheet was placed into a Technibrite Micro TB-1C opacity and color measurement instrument, from Technidyne Company using the cup of the color measurement instrument for readings. Light scattering coefficient is the scattering power divided by the weight of sheet and is determined according to TAPPI procedure T 425 om-96 (1996). Basis weight is the mass in grams per $m^2$ and is determined according to TAPPI procedure T410 om-98, 1998.

The bursting strength, also referred to herein as "Mullen", is the maximum hydrostatic pressure required to produce rupture of the paper when a controlled and constantly increasing pressure is applied through a rubber diaphragm to a circular area 30.5 mm in diameter. The bursting strength was measured according to TAPPI Test Method "Bursting Strength of Paper" T 403 om-97 1997. A burst tester, according to TAPPI T403 OM-85 and 87, commercially available under the designation Mullen from B. F. Perkins and son Inc., was employed.

The Hercules sizing test, also referred to herein as "HST" measures the water absorbency of paper, or more specifically measures the resistance to paper of permeation of an aqueous penetrant and is a useful general purpose test for degree of sizing. The size was measured according to TAPPI Test Method "Size Test for Paper by Ink Resistance (Hercules-type Method)" T 530 om-96 1996. The sizing test was performed using a single purpose photometer from Hercules Company.

Brightness, that is the reflectance of blue light having an effective wavelength of 457 nm and a spectral range of 400 to 500nm is determined according to TAPPI Test Method "Brightness of pulp, Paper and Paperboard (directional reflectance at 457 nm)" T452-om -98 (1998). Brightness is determined by placing a hand sheet into a Technibrite Micro TB-1C opacity and color measurement instrument, from Technidyne Company.

"L" represents lightness increasing from zero for black to 100 for perfect white. "L" is determined according to TAPPI Test Method "Color of Paper and Paperboard (45°/0° geometry)" T524-om-94 1994. "L" is determined by placing a hand sheet into a 1Technibrite Micro TB-1C opacity and color measurement instrument, from Technidyne Company.

"B" represents the degree of yellowness or blueness of the paper. "B" is determined according to TAPPI Test Method "Color of Paper and Paperboard 45°/0° geometry)" T524-om-94 1994. The "B" is determined by placing a hand sheet into a Technibrite Micro TB-1C opacity and color measurement instrument, from Technidyne Company. The reading when positive indicates yellowness, and when negative, indicates blueness.

Scott Bond method is determined according to TAPPI Test Method "Test for Interfiber Bond Using the Internal Bond Tester" T833 pm –94 provisional method 1994. The Scott bond was determined by using a Scott Internal Bond Tester from Muygen Corp.

The caliper was determined by measuring paper thickness with calipers. The results are presented below in Tables 1, 2, 3, and 4.

TABLE 1

| Example | Brightness | L | B | Scatter power | Opacity | Basis weight |
|---|---|---|---|---|---|---|
| Wood Pulp Control | 85.1 | 94.5 | 0.91 | 1.57 | 69.8 | 49 |
| Ex. 1 + 2 ASA | | | | | | |
| at 4 lb/ton wood pulp | 84.6 | 94.3 | 1.1 | 1.59 | 70.4 | 47.7 |
| at 7 lb/ton wood pulp | 84.7 | 94.4 | 1.14 | 1.59 | 70.2 | 48.7 |
| at 13 lb/ton wood pulp | 84.9 | 94.6 | 1.27 | 1.67 | 71.2 | 49.4 |
| Ex. 1 + 4 ASA | | | | | | |
| at 4 lb/ton wood pulp | 84.7 | 94.4 | 1.21 | 1.59 | 70.2 | 48.6 |
| at 7 lb/ton wood pulp | 84.7 | 94.4 | 1.17 | 1.62 | 70.6 | 48.2 |
| at 13 lb/ton wood pulp | 85 | 94.8 | 1.5 | 1.62 | 70.8 | 48.3 |
| Ex. 3 + 2 ASA | | | | | | |
| at 4 lb/ton wood pulp | 84.7 | 94.3 | 1.03 | 1.5 | 68.9 | 48.1 |
| at 7 lb/ton wood pulp | 84.7 | 94.4 | 1.06 | 1.53 | 69.3 | 48.7 |
| at 13 lb/ton wood pulp | 84.9 | 94.5 | 1.09 | 1.55 | 69.6 | 48.4 |
| Ex. 3 + 4 ASA | | | | | | |
| at 4 lb/ton wood pulp | 84.6 | 94.4 | 1.1 | 1.52 | 69.1 | 48.2 |
| at 7 lb/ton wood pulp | 85.3 | 94.7 | 1.11 | 1.68 | 71.4 | 48 |

TABLE 1-continued

| Example | Brightness | L | B | Scatter power | Opacity | Basis weight |
|---|---|---|---|---|---|---|
| at 13 lb/ton wood pulp | 84.4 | 94.4 | 1.27 | 1.59 | 70.4 | 48.6 |
| Comparative Ex. + 2 ASA | | | | | | |
| at 4 lb/ton wood pulp | 84.8 | 94.3 | 0.9 | 1.48 | 68.6 | 48.3 |
| at 7 lb/ton wood pulp | 85.2 | 94.5 | 0.91 | 1.56 | 69.6 | 48.6 |
| at 13 lb/ton wood pulp | 85.1 | 94.6 | 1.05 | 1.66 | 71.1 | 48.8 |
| Comparative Ex. + 4 ASA | | | | | | |
| at 4 lb/ton wood pulp | 84.3 | 94.3 | 1.08 | 1.54 | 69.6 | 48.7 |
| at 7 lb/ton wood pulp | 83.9 | 94.3 | 1.47 | 1.67 | 71.7 | 49 |
| at 13 lb/ton wood pulp | 84 | 94.5 | 1.6 | 1.62 | 73.5 | 49 |

TABLE 2

| Example | Scatt. Coeff. | Absorb. Coeff. | Water Drop | Mullen | Caliper mm | HST |
|---|---|---|---|---|---|---|
| Wood Pulp Control | 31.9 | 0.35 | 20 | 20.2 | 3.55 | 0 |
| Ex. 1 + 2 ASA | | | | | | |
| at 4 lb/ton wood pulp | 33.4 | 0.38 | 300+ | 20.9 | 3.55 | 0.3 |
| at 7 lb/ton wood pulp | 32.6 | 0.36 | 300+ | 18.7 | 3.66 | 0.3 |
| at 13 lb/ton wood pulp | 33.2 | 0.35 | 300+ | 17.6 | 3.81 | 0.3 |
| Ex. 1 + 4 ASA | | | | | | |
| at 4 lb/ton wood pulp | 32.8 | 0.36 | 163 | 23.9 | 3.64 | 0.5 |
| at 7 lb/ton wood pulp | 33.5 | 0.37 | 300+ | 20.3 | 3.64 | 0 |
| at 13 lb/ton wood pulp | 34.3 | 0.33 | 300+ | 15.7 | 3.76 | 0.5 |
| Ex. 3 + 2 ASA | | | | | | |
| at 4 lb/ton wood pulp | 31.3 | 0.35 | 62 | 23.2 | 3.61 | 1.5 |
| at 7 lb/ton wood pulp | 30.5 | 0.35 | 60.7 | 21.2 | 3.71 | 0 |
| at 13 lb/ton wood pulp | 36.7 | 0.35 | 62.7 | 19.1 | 3.72 | 0 |
| Ex. 3 + 4 ASA | | | | | | |
| at 4 lb/ton wood pulp | 31.5 | 0.35 | 64 | 23.7 | 3.77 | 0 |
| at 7 lb/ton wood pulp | 35.1 | 0.36 | 37.3 | 18.6 | 3.87 | 0 |
| at 13 lb/ton wood pulp | 32.3 | 0.37 | 280 | 20.9 | 3.79 | 0 |
| Comparative Ex. + 2 ASA | | | | | | |
| at 4 lb/ton wood pulp | 30.7 | 0.35 | 25 | 24.8 | 3.75 | 0 |
| at 7 lb/ton wood pulp | 32.1 | 0.34 | 27.7 | 22.7 | 3.67 | 0 |
| at 13 lb/ton wood pulp | 34.0 | 0.36 | 53 | 24.3 | 3.6 | 0 |
| Comparative Ex. + 4 ASA | | | | | | |
| at 4 lb/ton wood pulp | 31.6 | 0.37 | 94.7 | 26.8 | 3.59 | 0 |
| at 7 lb/ton wood pulp | 34.1 | 0.39 | 160 | 21.2 | 3.63 | 0 |
| at 13 lb/ton wood pulp | 36.9 | 0.39 | 300+ | 22.6 | 3.66 | 0 |

TABLE 3

| Example | Brightness | L | b | Scatter power | Opacity | Basis weight |
|---|---|---|---|---|---|---|
| Wood Pulp Control | 80.83 | 93.38 | 2.58 | 1.59 | 71.85 | 48.19 |
| Comp. Ex. | | | | | | |
| at 4 lbs/ton wood pulp | 82.07 | 93.95 | 2.61 | 1.79 | 73.95 | 48.07 |
| at 7 lbs/ton wood pulp | 82.66 | 94.25 | 2.68 | 1.99 | 76.09 | 49.04 |
| at 12 lbs/ton wood pulp | 83.17 | 94.44 | 2.66 | 2.05 | 76.52 | 48.43 |
| Example 15C: | | | | | | |
| at 4 lbs/ton wood pulp | 81.22 | 93.57 | 2.63 | 1.66 | 72.66 | 48.19 |
| at 7 lbs/ton wood pulp | 81.37 | 93.62 | 2.6 | 1.67 | 72.74 | 47.95 |
| at 12 lbs./ton wood pulp | 81.81 | 93.82 | 2.62 | 1.71 | 72.96 | 47.95 |
| Example 1 | | | | | | |
| at 4 lbs/ton wood pulp | 81.93 | 93.82 | 2.53 | 1.73 | 73.36 | 48.68 |
| at 7 lbs/ton wood pulp | 2.31 | 93.98 | 2.48 | 1.83 | 74.48 | 47.95 |
| at 12 lbs/ton wood pulp | 82.52 | 92.42 | 2.46 | 1.85 | 74.61 | 48.55 |
| Example 16C | | | | | | |
| at 4 lbs/ton wood pulp | 81.46 | 93.63 | 2.54 | 1.68 | 72.78 | 48.55 |
| at 7 lbs/ton wood pulp | 81.73 | 93.75 | 2.55 | 1.70 | 73.02 | 48.19 |
| at 12 lbs/ton wood pulp | 81.63 | 93.73 | 2.59 | 1.73 | 73.53 | 48.55 |

TABLE 4

| Example | Scatt. Coeff. | Absorb. Coeff. | Water Drop | Mullen | HST |
|---|---|---|---|---|---|
| Wood Pulp Control | 33.02 | 0.52 | 170 | 32.3 | 97.9 |
| Comp. Example | | | | | |
| at 4 lb/ton wood pulp | 37.15 | 0.48 | 141 | 22.38 | 3.4 |
| at 7 lb/ton wood pulp | 40.5 | 0.47 | 97 | 22.23 | 7.7 |
| at 12 lb/ton wood pulp | 42.26 | 0.46 | 87 | 19.88 | 12.1 |
| Ex. 15C | | | | | |
| at 4 lb/ton wood pulp | 34.45 | 0.51 | 151 | 28.48 | 83.8 |
| at 7 lb/ton wood pulp | 34.79 | 0.51 | 140 | 26.25 | 42.5 |
| at 12 lb/ton wood pulp | 35.58 | 0.48 | 103 | 23.8 | 11.2 |

TABLE 4-continued

| Example | Scatt. Coeff. | Absorb. Coeff. | Water Drop | Mullen | HST |
|---|---|---|---|---|---|
| Ex. 1 R | | | | | |
| at 4 lb/ton wood pulp | 35.58 | 0.48 | 133 | 25.5 | 243.4 |
| at 7 lb/ton wood pulp | 38.12 | 0.49 | 113 | 21.4 | 306.3 |
| at 12 lb/ton wood pulp | 38.07 | 0.47 | 100 | 20.45 | 321.3 |
| Ex. 16C | | | | | |
| at 4 lb/ton wood pulp | 34.53 | 0.49 | 157 | 29.18 | 114.2 |
| at 7 lb/ton wood pulp | 35.29 | 0.49 | 115 | 30.43 | 45.1 |
| at 12 lb/ton wood pulp | 35.72 | 0.50 | 121 | 25.65 | 15.2 |

The opacifying composition of Example 1 was added to the furnish along with 4 pounds per ton of ASA. The paper made from the furnish was evaluated for burst strength. The results are presented below.

TABLE 5

| Example | HST Strength test |
|---|---|
| Wood Pulp Control | 141.5 |
| Wood Pulp Control | 145 |
| Example 1 | |
| 2 lb/ton wood pulp | 120.6 |
| 4 lb/ton wood pulp | 162.8 |
| 7 lb/ton wood pulp | 153.6 |
| Comparative Example | |
| 2 lb/ton wood pulp | 97.6 |
| 4 lb/ton wood pulp | 57.1 |
| 7 lb/ton wood pulp | 34.3 |

The properties of paper made with the opacifying composition of Example 2 with 4 pounds/ton ASA are presented below in Tables 4 and 5.

TABLE 6

| Example | Brightness | L | B | Scatter power | Opacity | Basis weight |
|---|---|---|---|---|---|---|
| Wood Pulp Control | 79.91 | 93.71 | 3.72 | 1.79 | 74.41 | 48.55 |
| Comp. Ex.: | | | | | | |
| at 2 lb/ton wood pulp | 79.8 | 93.51 | 3.4 | 1.71 | 73.43 | 48.43 |
| at 4 lb/ton wood pulp | 79.71 | 93.74 | 3.93 | 1.82 | 74.74 | 48.43 |
| at 7 lb/ton wood pulp | 79.76 | 93.8 | 4.24 | 1.92 | 75.97 | 48.31 |
| Wood Pulp Control | 78.53 | 93.29 | 4.09 | 1.65 | 72.92 | 48.92 |
| Ex. 2 | | | | | | |
| at 2 lb/ton wood pulp | 78.80 | 93.27 | 3.83 | 1.72 | 73.97 | 48.19 |
| at 4 lb/ton wood pulp | 79.23 | 93.55 | 3.99 | 1.79 | 74.54 | 48.31 |
| at 7 lb/ton wood pulp | 79.50 | 93.53 | 3.74 | 1.84 | 75.3 | 49.04 |
| Wood Pulp Control | 78.73 | 93.3 | 4.0 | 1.7 | 73.54 | 48.68 |

TABLE 7

| Example | Scatt. Coeff. | Absorb. Coeff. | HST | Scot Bond | Mullen | Caliper |
|---|---|---|---|---|---|---|
| Wood Pulp Control | 36.87 | 0.52 | 123.5 | 160 | 25.03 | 4.03 |
| Comp. Ex. | | | | | | |
| at 2 lb/ton wood pulp | 35.27 | 0.52 | 102.4 | 150 | 24.85 | 4 |
| at 4 lb/ton wood pulp | 37.62 | 0.52 | 71 | 135 | 22.28 | 4.03 |
| at 7 lb/ton wood pulp | 39.81 | 0.54 | 19.8 | 104 | 22.63 | 4.06 |
| Wood Pulp Control | 33.73 | 0.54 | 101.1 | 164 | 26.73 | 3.89 |
| Ex. 2 | — | — | — | — | — | — |
| at 2 lb/ton wood pulp | 35.64 | 0.57 | 98.9 | 146 | 24.38 | 3.9 |
| at 4 lb/ton wood pulp | 37.01 | 0.54 | 106.8 | 134 | 22.95 | 4.01 |
| at 7 lb/ton wood pulp | 37.46 | 0.56 | 168.7 | 125 | 22.38 | 4.05 |
| Wood Pulp Control | 34.85 | 0.55 | 121.3 | 154 | 26.3 | 3.87 |

The results show that the opacifying compositions significantly increase the optical properties of the paper without a significant decrease in paper strength.

Although certain embodiments of this invention have been shown and described, various adaptations and modifications can be made without departing from the scope of the invention as defined in the appended claims.

What is claimed is:

1. An opacifier, comprising:

from 5% to 60% by weight, of at least one aromatic polymer; and from 40% to 95% by weight, of at least one amide having the following structure:

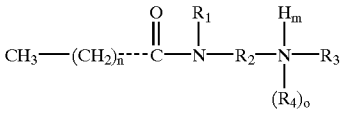

wherein:

m is an integer from 0–1;

n is an integer from 11–21;

o is an integer from 0–1;

$R_1$ is a hydrogen;

$R_2$ is an alkyl group having from 1 to 15 carbon atoms;

$R_3$ is an aliphatic alcohol group having from 1 to 15 carbon atoms; and $R_4$ is:

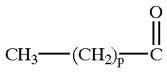

wherein p is an integer from 11–21; and water further wherein the opacifier has a pH of 7.5 or greater than 7.5.

2. The opacifier of claim 1, wherein the aromatic polymer is an aromatic acrylic polymer.

3. The opacifier of claim 2, wherein the aromatic polymer is a styrene acrylic polymer.

4. The opacifier of claim 1, wherein the aromatic polymer is a styrene polymer.

5. The opacifier of claim 4, wherein the aromatic polymer is a styrene maleic anhydride resin.

6. The opacifier of claim 1, wherein the amide comprises a monoamide having the following formula:

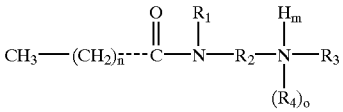

wherein: m is an integer from 0–1;

n is an integer from 11–17;

o equals 0;

$R_1$ is a hydrogen;

$R_2$ is an alkyl group having from 1 to 15 carbon atoms; and $R_3$ is an aliphatic alcohol group having from 1 to 15 carbon atoms;

$R_4$ is:

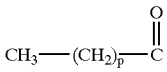

wherein p is an integer from 11–17.

7. The opacifier of claim 1, wherein the amide comprises a diamide having the following formula:

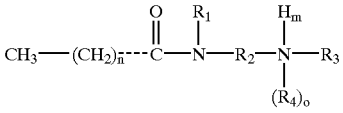

wherein m is an integer from 0–2;

n is an integer from 11–17;

o equals 1;

$R_1$ is a hydrogen;

$R_2$ is an alkyl group having from 1 to 15 carbon atoms;

$R_3$ is an aliphatic alcohol group having from 11 to 15 carbon atoms;

and $R_4$ is

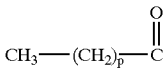

wherein p is an integer from 11–17.

8. The opacifier of claim 1, wherein the amide comprises a diamide having the following formula:

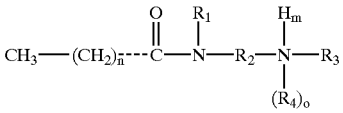

wherein: m is an integer from –2;

n is an integer from 11–17;

o equals 1;

$R_1$ is hydrogen;

$R_2$ is an alkyl group having from 1 to 15 carbon atoms;

$R_3$ is an aliphatic alcohol group having from 11 to 15 carbon atoms;

and $R_4$ is

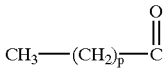

wherein p is an integer from 11–17; and a monoamide having the following formula:

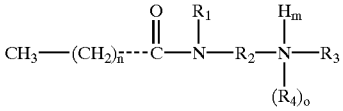

wherein: m is an integer from 0–2;

n is an integer from 11–17;

o equals 0;

$R_1$ is a hydrogen;

$R_2$ is an alkyl group having from 1 to 15 carbon atoms; and $R_3$ is an aliphatic alcohol group having from 1 to 15 carbon atoms.

9. The opacifier of claim 6, wherein the aromatic acrylic polymer is a styrene acrylic polymer.

10. The opacifier of claim 1, admixed with water to form an emulsion.

11. The opacifier of claim 1, wherein the aromatic polymer is a aromatic acrylic polymer, and the amide comprises a monoamide having the following formula:

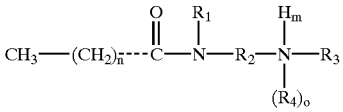

wherein: m is an integer from 0 to 2;

n is an integer from 15 to 17;

o equals 0;

$R_1$ is a hydrogen;

$R_2$ is an alkyl group having from 2 to 6 carbon atoms;

$R_3$ is an aliphatic alcohol group having from 2 to 6 carbon atoms and a diamide having the following formula: mid range

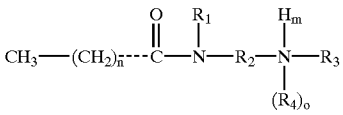

wherein: m is an integer from 0 to 2;

n is an integer from 15 to 17;

o equals 1;

$R_1$ is a hydrogen;

$R_2$ is an alkyl group having from 2 to 6 carbon atoms;

$R_3$ is an aliphatic alcohol group having from 2 to 6 carbon atoms;

and $R_4$ is

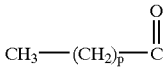

wherein p is an integer from 15 to 17.

12. The opacifier of claim 11, admixed with water.

13. The opacifier of claim 1, wherein the aromatic polymer is a styrene acrylic polymer having a weight average molecular weight of from 7,500 to 9,000 and is present from 30% to 40%, the stearamide is present from 60% to 70%, the mono-stearamide has the following formula:

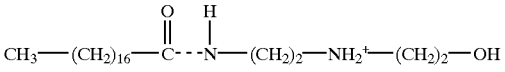

and the di-stearamide has the following formula:

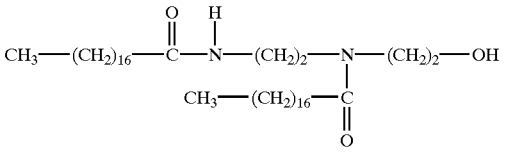

14. The opacifier of claim 6, wherein: aromatic polymer is a styrene maleic anhydride resin having a weight average molecular weight of from 500 to 10,000 and is present from 30% to 40%, the stearamide is present from 60% to 70%, and the mono-stearamide has the following formula:

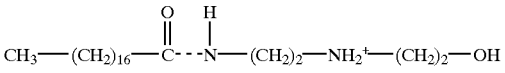

and the di-stearamide has the following formula:

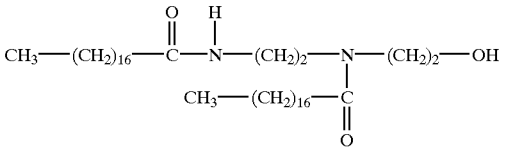

15. The opacifier of claim 1, wherein the opacifier comprises:

from 15% to.50% of at least one aromatic polymer;

50 to 85% of at least one stearamide; wherein the stearamide comprises from 1% to 50% of at least one mono-stearamide; and from 50% to 99% of at least one di-stearamide;

and the opacifying composition has a pH of from 7.5 to 11.

16. The opacifier of claim 15, admixed with water.

17. A method of opacifying paper comprising the following steps:

providing an opacifier comprising:

from 5% to 60% by weight of the opacifier, of at least one aromatic polymer; and from 40% to 95% by weight of the opacifier, at least one amide having the following structure:

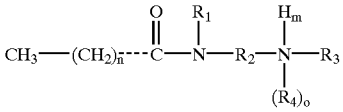

wherein: m is an integer from 0–2;

n is an integer from 11–17;

o is an integer from 0–1;

$R_1$ is a hydrogen;

$R_2$ is an alkyl group having from 1 to 15 carbon atoms;

$R_3$ is an aliphatic alcohol group having from 1 to 15 carbon atoms; and $R_4$ is:

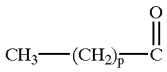

wherein p is an integer from 11–17, combining said opacifying composition with a cellulose pulp slurry; and then forming paper from cellulose pulp slurry.

18. The method of claim 17, wherein the aromatic polymer is an aromatic acrylic polymer or an aromatic anhydride polymer and the amide is selected from the group consisting of: a monoamide having the following formula:

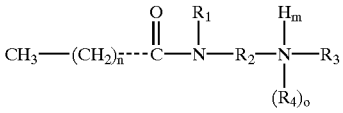

wherein: m is an integer from 0–2;

n is an integer from 11–17;

o equals 0;

$R_1$ is a hydrogen;

$R_2$ is an alkyl group having from 1 to 15 carbon atoms; and $R_3$ is an aliphatic alcohol group having from 1 to 15 carbon atoms;

a diamide having the following formula:

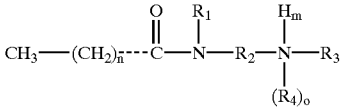

wherein: m is an integer from 0–2;

n is an integer from 11–17;

o equals 1;

$R_1$ is a hydrogen;

$R_2$ is an alkyl group having from 1 to 15 carbon atoms;

$R_3$ is an aliphatic alcohol group having from 11 to 15 carbon atoms;

and $R_4$ is

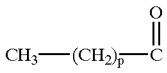

wherein p is an integer from 11–17;

and mixtures thereof.

19. The method of claim 17, wherein the aromatic acrylic polymer is a styrene acrylic polymer, the aromatic anhydride polymer is a styrene maleic anhydride resin, the diamide has the following formula:

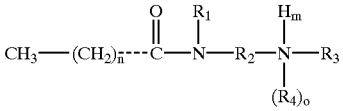

wherein: m is an integer from 0–2;

n is an integer from 11–17;

o equals 1;

$R_1$ is a hydrogen;

$R_2$ is an alkyl group having from 1 to 15 carbon atoms;

$R_3$ is an aliphatic alcohol group having from 11 to 15 carbon atoms; and $R_4$ is

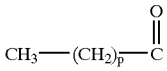

wherein p is an integer from 11–17; and the monoamide has the following formula:

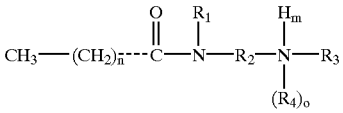

wherein: m is an integer from 0–2;

n is an integer from 11–17;

o equals 0;

$R_1$ is a hydrogen;

$R_2$ is an alkyl group having from 1 to 15 carbon atoms; and $R_3$ is an aliphatic alcohol group having, from 1 to 15 carbon atoms.

20. The method of claim 19, wherein the opacifier comprises:

from 15% to 50% of at least one aromatic polymer;

50 to 85% of at least one stearamide; wherein the stearamide comprises from 1% to 50% at least one mono-stearamide; and from 50% to 99% at least one di-stearamide;

and the opacifying composition has a pH of from 7.5 to 11 and the wood pulp has a pH of from 6.5 to 9.

21. The method of claim 20, wherein aromatic polymer is a styrene acrylic polymer having a weight average molecular weight of from 7,500 to 9,000 and is present from 30% to 40%, the stearamide is present from 60% to 70%, the mono-stearamide has the following formula:

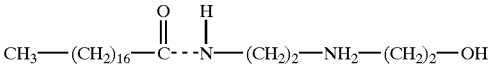

and the di-stearamide has the following formula:

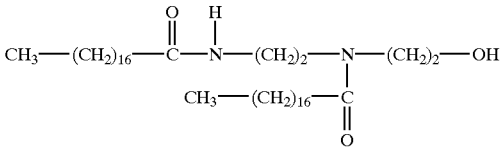

22. The method of claim 20, wherein: aromatic polymer is a styrene maleic anhydride resin having a weight average molecular weight of from 500 to 10,000 and is present from 30 to 40%, the stearamide is present from 60% to 70% and the mono-stearamide has the following formula:

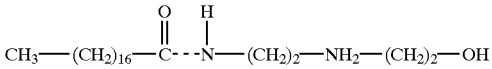

and the di-stearamide has the following formula:

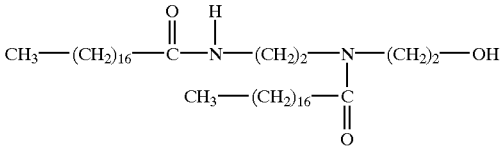

23. The method of claim 20, further comprising adding alkyl succinic anhydride to the pulp slurry.

24. A caper sheet comprising:

cellulose fibers;

at least one aromatic polymer; and at least one amide having the following formula:

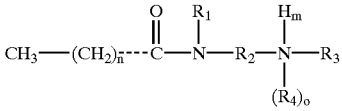

wherein: m is an integer from 0–2;

n is an integer from 11–17;

o is an integer from 0–1;

$R_1$ is a hydrogen;

$R_2$ is an alkyl group having from 1 to 15 carbon atoms; and $R_3$ is an aliphatic alcohol group having, from 1 to 15 carbon atoms; and $R_4$ is:

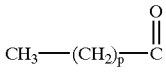

wherein p is an integer from 11–17.

25. The sheet of claim 24, wherein the sheet further comprises alkyl succinic anhydride.

26. The sheet of claim 25, wherein the aromatic polymer is a styrene acrylic polymer or a styrene maleic anhydride polymer and the amide has the following structure:

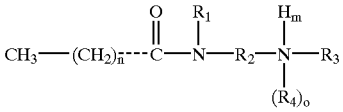
wherein: m is an integer from 0–2;
n is an integer from 11–17;
o is an integer from 0–1;
$R_1$ is a hydrogen;
$R_2$ is an alkyl group having from 1 to 15 carbon atoms;
$R_3$ is an aliphatic alcohol group having, from 1 to 15 carbon atoms; and
$R_4$ is:
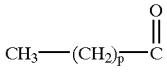
wherein p is an integer from 11–17.
* * * * *

UNITED STATES PATENT AND TRADEMARK OFFICE

CERTIFICATE OF CORRECTION

PATENT NO. : 6,432,269 B1
DATED : August 13, 2002
INVENTOR(S) : Louis Robert Dragner It is certified that error appears in the above-identified patent and that said Letters Patent is hereby corrected as shown below:

Column 13,
Line 60, should read -- wherein: m is an integer from 0-2; --

Column 18,
Line 35, please delete the word "caper" and insert -- paper --.

Signed and Sealed this

Nineteenth Day of August, 2003

JAMES E. ROGAN
*Director of the United States Patent and Trademark Office*